US010876687B2

(12) United States Patent
Philippe et al.

(10) Patent No.: US 10,876,687 B2
(45) Date of Patent: Dec. 29, 2020

(54) SEALED AND THERMALLY INSULATING WALL FOR A TANK FOR STORING FLUID

(71) Applicant: GAZTRANSPORT ET TECHNIGAZ, Saint Remy les Chevreuse (FR)

(72) Inventors: Antoine Philippe, Gif sur Yvette (FR); Bruno Deletre, Versailles (FR); Johan Bougault, Jouy en Josas (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 0 days.

(21) Appl. No.: 14/764,697

(22) PCT Filed: Jan. 30, 2014

(86) PCT No.: PCT/FR2014/050169
§ 371 (c)(1),
(2) Date: Jul. 30, 2015

(87) PCT Pub. No.: WO2014/125186
PCT Pub. Date: Aug. 21, 2014

(65) Prior Publication Data

US 2015/0354756 A1 Dec. 10, 2015

(30) Foreign Application Priority Data

Feb. 14, 2013 (FR) ..... 13 51263

(51) Int. Cl.
*F17C 13/00* (2006.01)
*F17C 3/04* (2006.01)
(Continued)

(52) U.S. Cl.
CPC ..... *F17C 13/001* (2013.01); *B63B 3/68* (2013.01); *B63B 25/16* (2013.01); *B65D 90/027* (2013.01);
(Continued)

(58) Field of Classification Search
CPC ..... B63B 25/16; B65D 88/128; F17C 2270/0105; F17C 13/001; F17C 2203/03;
(Continued)

(56) References Cited

U.S. PATENT DOCUMENTS 2,365,334 A * 12/1944 De Vries ..... B27D 1/08 156/211
3,155,266 A * 11/1964 Katsuro ..... B63B 25/16 220/560.03
(Continued)

FOREIGN PATENT DOCUMENTS

EP 2412624 A1 2/2012
FR 2781557 A1 1/2000
(Continued)

OTHER PUBLICATIONS

English machine translation of Hayashi JP 2007-155065.*
International Search Report for PCT/FR2014/050169 filed Jan. 30, 2014.

*Primary Examiner* — Andrew D Stclair
(74) *Attorney, Agent, or Firm* — Notaro, Michalos & Zaccaria P.C.

(57) ABSTRACT

A sealed and thermally insulating wall for a tank for storing fluid includes a heat-insulating panel and a sealing plate. The inner face of the heat-insulating panel has a stress-relieving slot.

19 Claims, 5 Drawing Sheets

(51) Int. Cl.

| | |
|---|---|
| ***F17C 6/00*** | (2006.01) |
| ***F17C 13/08*** | (2006.01) |
| ***B63B 25/16*** | (2006.01) |
| ***B65D 90/02*** | (2019.01) |
| ***B63B 3/68*** | (2006.01) |
| ***F17C 3/02*** | (2006.01) |
| ***B65D 90/22*** | (2006.01) |
| ***B65D 90/06*** | (2006.01) |

(52) U.S. Cl.
CPC ..... *B65D 90/06* (2013.01); *B65D 90/22* (2013.01); *F17C 3/027* (2013.01); *F17C 3/04* (2013.01); *F17C 6/00* (2013.01); *F17C 13/082* (2013.01); *F17C 2201/0157* (2013.01); *F17C 2201/052* (2013.01); *F17C 2203/0329* (2013.01); *F17C 2203/0333* (2013.01); *F17C 2203/0358* (2013.01); *F17C 2203/0631* (2013.01); *F17C 2203/0651* (2013.01); *F17C 2221/033* (2013.01); *F17C 2223/0161* (2013.01); *F17C 2223/033* (2013.01); *F17C 2227/04* (2013.01); *F17C 2260/01* (2013.01); *F17C 2260/011* (2013.01); *F17C 2270/0105* (2013.01); *F17C 2270/0107* (2013.01)

(58) Field of Classification Search
CPC .... F17C 2203/0329; F17C 3/04; F17C 3/025; F17C 3/027
See application file for complete search history.

(56) References Cited

U.S. PATENT DOCUMENTS

| | | | | | |
|---|---|---|---|---|---|
| 3,302,358 | A | | 2/1967 | Glover | |
| 3,670,917 | A | * | 6/1972 | Nishimaki | F17C 13/004 220/560.15 |
| 3,765,558 | A | * | 10/1973 | Withers | B29C 70/08 220/560.15 |
| 4,021,982 | A | * | 5/1977 | Kotcharian | F16L 59/02 220/592.26 |
| 6,035,795 | A | * | 3/2000 | Dhellemmes | B63B 25/16 114/74 A |
| 9,335,003 | B2 | * | 5/2016 | Shin | B63B 25/16 |
| 2005/0082297 | A1 | * | 4/2005 | Dhellemmes | B63B 3/68 220/562 |
| 2006/0207212 | A1 | * | 9/2006 | Durney | E04B 2/78 52/846 |
| 2011/0056955 | A1 | * | 3/2011 | Joh | B63B 25/16 220/560.12 |
| 2011/0186580 | A1 | * | 8/2011 | Joh | B63B 25/16 220/560.06 |
| 2013/0255562 | A1 | * | 10/2013 | Canler | F17C 3/027 114/74 A |
| 2014/0299038 | A1 | * | 10/2014 | Shin | B63B 25/16 114/74 A |

FOREIGN PATENT DOCUMENTS

| | | | | | |
|---|---|---|---|---|---|
| JP | 48-34268 | B | | 10/1973 | |
| JP | 2007-155065 | | * | 6/2007 | |
| WO | 2009/059617 | A1 | | 5/2009 | |
| WO | WO 2012072906 | A1 | * | 6/2012 | F17C 3/027 |

* cited by examiner

SEALED AND THERMALLY INSULATING WALL FOR A TANK FOR STORING FLUID

TECHNICAL FIELD

The invention relates to the field of sealed and thermally insulating tanks for storing and/or transporting fluid, such as cryogenic fluid.

The invention relates more particularly to the field of tanks, the sealing thereof being implemented by metal membranes having corrugations which provide said metal membranes with a flexibility and a capacity for elongation in one or more directions of a plane.

Such tanks are used, in particular, for the transport or storage of liquefied natural gas (LNG) which is stored at atmospheric pressure at approximately −162° C.

PRIOR ART

Sealed and thermally insulating tanks for transporting and/or storing cryogenic fluid are known from the patent application FR 2 861 060, said tanks comprising heat-insulating panels covered by a corrugated sealing membrane. The sealing membrane comprises an inner face which is designed to be in contact with the fluid contained in the tank and an outer face which is anchored to the inner face of the heat-insulating panel. The sealing membrane consists of a plurality of metal plates which are made of stainless steel and have series of perpendicular corrugations which enable the forces to be absorbed. The corrugated plates are welded to one another along the edges thereof and are anchored to the panels by welding the edges of the plates to strips which are also made of stainless steel and riveted to said heat-insulating panels.

The inner face of the heat-insulating panels has slots extending in the transverse direction relative to the length of the vessel, over the entire length of the heat-insulating panels. Such slots permit a deformation of the corrugations, without the heat-insulating panels becoming cracked when the tank is subjected to cold temperatures.

SUMMARY

One idea on which the invention is based is to propose a sealed and thermally insulating wall having a corrugated membrane which is resistant to low temperatures and has limited flexion when subjected to cold temperatures.

According to one embodiment, the invention provides a sealed and thermally insulating wall for a tank for storing fluid, comprising:

- a heat-insulating panel having an inner face; and
- a sealing plate having an inner face which is designed to be in contact with the fluid contained in the tank and an outer face which is anchored to the inner face of the panel in the region of a plurality of anchoring areas, said sealing plate comprising at least one corrugation which protrudes from the side of the inner face of the sealing plate, extending in a direction $d_1$; in which:
- the inner face of the heat-insulating panel comprises a stress-relieving slot between two adjacent anchoring areas arranged on either side of said corrugation, said stress-relieving slot having an axis extending in the direction $d_1$ so as to permit a deformation of the corrugation transversely to the direction $d_1$; and
- the stress-relieving slot has a length which is less than the dimension of the heat-insulating panel along the axis of the stress-relieving slot.

Thus, the corrugation provides the sealing membrane with a flexibility which enables it to deform, in particular under the action of the flexion of the heat-insulating panels and the thermal contraction of the sealing membrane.

Moreover, the stress-relieving slot makes it possible to exploit fully this corrugation since it permits a deformation of the sealing membrane without imposing mechanical stresses which are too great on the heat-insulating panel.

Moreover, when a tank is filled with a cryogenic fluid, such as liquefied natural gas, the difference in temperature between the outside of the tank and the inside generates a thermal gradient within the heat-insulating panels. This thermal gradient may cause the flexion of the heat-insulating panels and thus the flexion of the sealing membrane. In contrast to a slot extending on either side of a heat-insulating panel, a stress-relieving slot which does not extend over the entire width or length of the panel makes it possible for the panel to preserve a certain degree of rigidity and thus limits the impact of a stress-relieving slot on the flexibility of the heat-insulating panel under thermal load.

According to the embodiments, such a sealed and thermally insulating wall may comprise one or more of the following features:

- the stress-relieving slot does not extend as far as the periphery of the heat-insulating panel.
- the stress-relieving slot is a through-slot which opens into the outer face of the heat-insulating panel.
- the stress-relieving slot is a blind slot which does not open into the outer face of the panel and comprises ends which are radiused.
- the stress-relieving slot extends opposite the corrugation.
- the sealing plate comprises a corrugation extending in a direction d2 perpendicular to the direction d1, the inner face of the heat-insulating panel comprising a stress-relieving slot between two adjacent anchoring areas extending on either side of said corrugation extending in the direction d2, said stress-relieving slot having an axis extending in the direction d2 and having a length which is less than the dimension of the heat-insulating panel along the axis of said stress-relieving slot.
- the sealing plate comprises a first series of corrugations extending in the direction $d_1$ and a second series of corrugations extending in the direction $d_2$, the outer face of the sealing plate being anchored to the inner face of the heat-insulating panel in the region of a plurality of anchoring areas arranged between the corrugations of the first and the second series, the inner face of the heat-insulating panel comprising a stress-relieving slot between each pair of adjacent anchoring areas extending on either side of a corrugation, said stress-relieving slot having an axis which extends in the direction $d_1$ or $d_2$ of said corrugation and having a length which is less than the dimension of the heat-insulating panel along the axis of said stress-relieving slot.
- a stress-relieving slot has a length corresponding to the distance between two intersections of corrugations in the direction $d_1$ or $d_2$ of the stress-relieving slot.
- the anchoring areas are aligned along two secant edges of the metal plate.
- a stress-relieving slot adjacent to the intersection between the alignments of the anchoring areas has an additional portion extending in a central direction d3 relative to the directions d1 or d2.
- the sealing plate is a metal plate and the inner face of the heat-insulating panel comprises, in the region of the anchoring areas, metal anchoring plates permitting the welding of the sealing plate to the heat-insulating panel.

the heat-insulating panel comprises a layer of insulating polymer foam sandwiched between two sheets of plywood.

the heat-insulating panel constitutes a primary insulating barrier of the wall, the wall further comprising a secondary sealed and insulating barrier, the heat-insulating panel being fastened to the secondary sealed and insulating barrier by a fastening member cooperating with a central area of the panel, remote from the edges of the panel.

the heat-insulating panel comprises, in a central area, members for fixing to a load-bearing structure.

According to one embodiment, the invention also provides a fluid storage tank comprising a load-bearing structure and at least one wall as mentioned above which is fixed to the load-bearing structure.

Such a tank may form part of a land-based storage installation, for example to store LNG, or may be installed in a floating structure which is inshore or offshore, in particular an LNG carrier, a floating storage and regasification unit (FSRU), a floating production, storage and offloading unit (FPSO) and the like.

According to one embodiment, a vessel for the transport of a fluid comprises a double hull forming the load-bearing structure and a tank as mentioned above and arranged in the double hull.

According to one embodiment, the invention also provides a use of a vessel as mentioned above and in which a fluid is conducted through insulated pipelines from or toward a floating or land-based storage installation toward or from the tank of the vessel in order to load or unload the vessel.

According to one embodiment, the invention also provides a system for the transfer of a fluid, the system comprising the aforementioned vessel, insulated pipelines being arranged so as to connect the tank installed in the hull of the vessel to a floating or land-based storage installation and a pump to drive a flow of fluid through the insulated pipelines from or toward the floating or land-based storage installation toward or from the tank of the vessel.

According to one embodiment, the invention is particularly advantageous when the means for fastening the heat-insulating panels to the load-bearing structure are not capable of absorbing the flexural stresses of the heat-insulating element, for example when the heat-insulating panel is not fixed in its peripheral area but solely in the region of a central area of its external surface.

According to one embodiment, the invention also makes it possible to obtain improved behavior relative to the ageing of the insulating foam of the heat-insulating panels. More specifically, the stress-relieving slots do not extend over the entire length or width of the heat-insulating panels, the exchange surface between the insulating foam and the ambient air being restricted such that the diffusion of the expansion gas outside the cells of the foam and the migration of air therein are limited.

The invention will be understood, and further objects, details, features and advantages thereof, will appear more clearly from the following description of several particular embodiments of the invention provided solely by way of illustrative and non-limiting example with reference to the accompanying drawings, in which:

FIG. 1 is a perspective view of a heat-insulating panel.

FIGS. 2, 3, and 4 are detailed views according to three variants of a heat-insulating panel in the area receiving the corners of the metal plates.

Conventionally, the terms "external" and "internal" are used to define the relative position of one element relative to another, with reference to the inside and outside of the tank.

Each tank wall in the thickness direction, successively from the inside to the outside of the tank, has at least one sealing membrane in contact with the fluid contained in the tank, a thermally insulating barrier and a load-bearing structure, not shown. In one particular embodiment, not illustrated, a wall may also comprise two levels of sealing and thermal insulation.

Figure 1:
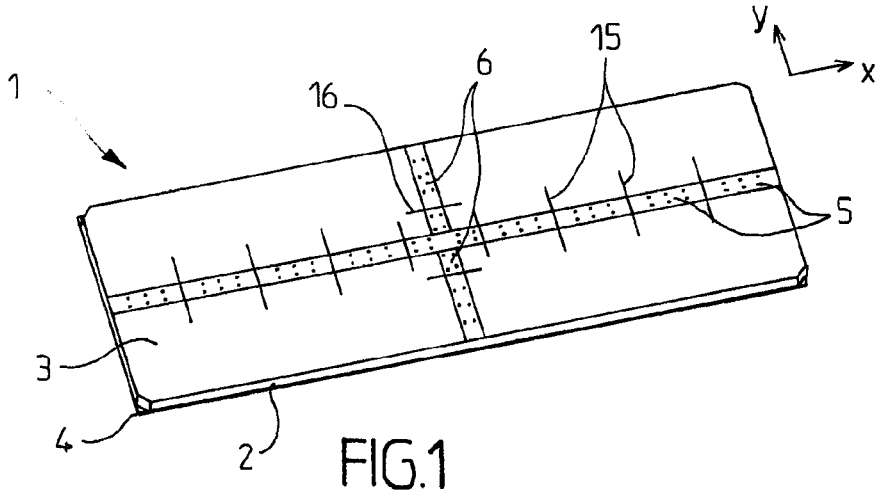

FIG. 1 shows a heat-insulating panel 1. The panel 1 in this case has substantially the shape of a rectangular parallelepiped. It comprises a layer of insulating polymer foam 2 sandwiched between an internal rigid plate 3 and an external rigid plate 4. The internal rigid plate 3 and the external rigid plate 4 are, for example, sheets of plywood bonded to said foam layer 2. The insulating polymer foam may, in particular, be a polyurethane-based foam. The polymer foam may advantageously be reinforced by glass fibers which contribute to reducing its thermal contraction.

By way of example, the panel 1 has a length of 3 meters by a width of 1 meter. The internal sheet of plywood 3 may have a thickness of 12 mm; the external sheet of plywood 4: a thickness of 9 mm and the layer of insulating foam 2: a thickness of 200 mm. Naturally, the dimensions and thicknesses are provided by way of indication and vary according to the desired applications and thermal insulating performance.

Figure 7:
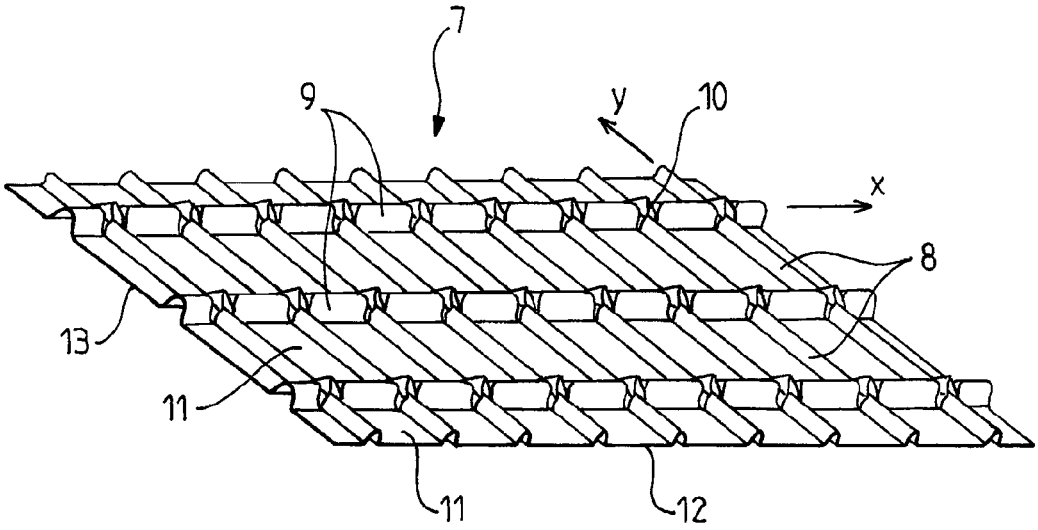
FIG. 7 is a perspective view of a corrugated metal plate of the sealing membrane.

The internal surface of the panel 1 comprises metal anchoring plates 5, 6 designed to anchor the metal plates 7, one example thereof being illustrated in FIG. 7, forming the sealing membrane. Metal anchoring plates 5 extend longitudinally on the internal plate 3 of the panel 1 and metal anchoring plates 6 extend transversely. The metal anchoring plates 5, 6 are riveted, for example, to the internal plate 3 of the panel 1. The metal anchoring plates 5, 6 may be produced, in particular, from stainless steel or Invar®: an alloy of iron and nickel, the principal property thereof being that it has a very low coefficient of expansion. The thickness of the metal anchoring plates 5, 6 is, for example, in the order of 2 mm. A thermal protection strip, not illustrated, may be placed below the metal anchoring plates 5, 6. The anchoring between the metal plate 7 and the metal anchoring plates 5, 6 is implemented by tack welds.

The sealing membrane is obtained by assembling multiple metal plates 7 welded to one another along their edges. As illustrated in FIG. 7, a metal plate 7 comprises a first series of parallel corrugations, called lower corrugations 8, extending in a direction y and a second series of parallel corrugations, called upper corrugations 9 extending in a direction x. The directions x and y of the series of corrugations 8, 9 are perpendicular. The corrugations 8, 9 protrude from the side of the inner face of the metal plate 7. The edges of the metal plate 7 are in this case parallel to the corrugations 8, 9. The metal plate 7 comprises between the corrugations 8, 9 a plurality of planar surfaces 11. It is worth noting that the terms "upper" and "lower" have a relative meaning and indicate that the first series of corrugations 8 has a height which is lower than the second series of corrugations 9. In the region of an intersection 10 between a lower corrugation 8 and an upper corrugation 9, the lower corrugation is discontinuous, i.e. it is interrupted by a fold which extends the top edge of the upper corrugation 9 protruding above the top edge of the lower corrugation 8. The corrugations 8, 9 permit the sealing membrane to be substantially flexible in order to be able to deform under the effect of stresses, in particular thermal stresses, generated by the fluid stored in the tank.

The metal plate 7 is produced from stainless steel or aluminum sheet, shaped by folding or stamping. Further metals or alloys are also possible. By way of example, the metal plate 7 has a thickness of approximately 1.2 mm. Further thicknesses are also conceivable, given that a thickening of the metal plate 7 results in an increase in its cost and generally increases the rigidity of the corrugations.

In the region of one of the two transverse edges 13 and in the region of one of the two longitudinal edges 12, the metal plate 7 has a stamped strip, not shown, which is inwardly offset in the thickness direction relative to the plane of the plate 7 in order to cover the edge of an adjacent metal plate 7.

Figure 8:
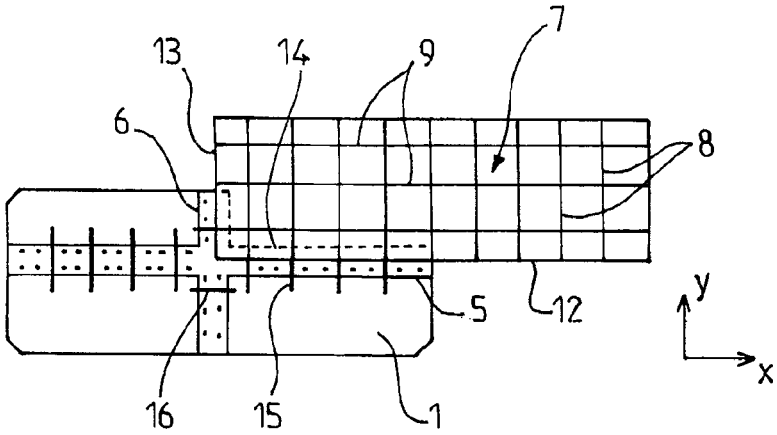
FIG. 8 is a plan view illustrating the relative positioning of a metal plate of the sealing membrane relative to a heat-insulating panel.

A relative positioning of a metal plate 7 in relation to a heat-insulating panel 1 is illustrated in FIG. 8. The metal plates 7 in this case are arranged offset by half a length and half a width relative to the heat-insulating panel 1. A wall comprises, therefore, a plurality of heat-insulating panels 1 and a plurality of metal plates 7 and each of said metal plates 7 extends over four adjacent heat-insulating panels 1.

One of the longitudinal edges 12 of the metal plate 7 is anchored to the heat-insulating panel 1 by welding said longitudinal edge 12 to the metal anchoring plates 5. Similarly, one of the transverse edges 13 is anchored to the heat-insulating panel 1 by welding said transverse edge 13 to the metal anchoring plates 6. The anchoring areas 14 between the metal plate 7 and the heat-insulating panel 1 are located on either side of the corrugations 8, 9. In other words, the anchoring areas 14 are formed at the interface between the planar portions 11 of the edges 12, 13 of the metal plates 7 extending on either side of the corrugations 8, 9 and the metal anchoring plates 5, 6.

It is noteworthy that the central corrugation of each of the series of corrugations 8, 9 advantageously extends opposite the join between two adjacent heat-insulating panels 1.

The internal surface of the heat-insulating panel 1 is provided with a plurality of stress-relieving slots 15, 16. A first series of stress-relieving slots 15 extends in the direction y of the corrugations 8. A second series of stress-relieving slots 16 extends in the direction x of the corrugations 9.

In FIG. 8, the heat-insulating panel 1 has a stress-relieving slot 15, 16 between each pair of adjacent anchoring areas 14 extending on either side of a corrugation 8, 9. The stress-relieving slots 15, 16 extend in this case opposite their respective corrugation 8, 9. The stress-relieving slots 15, 16 are thus arranged to permit a deformation of their respective corrugation 8, 9 according to a direction transversely to the direction thereof. More specifically, without the stress-relieving slot 15, 16, any corrugation 8, 9 bordered by anchoring areas 14 is not able to be deformed without imposing significant mechanical stresses on the heat-insulating panel 1.

The stress-relieving slots 15, 16 have lengths which are shorter than the dimension of the heat-insulating panel 1 along their axis. In other words, the stress-relieving slots 15, 16 do not extend as far as the periphery of the heat-insulating panel 1. Advantageously, the length of a stress-relieving slot 15, 16 substantially corresponds to the spacing between two intersections 10 of corrugations in the direction of the slot 15, 16.

Figure 5:
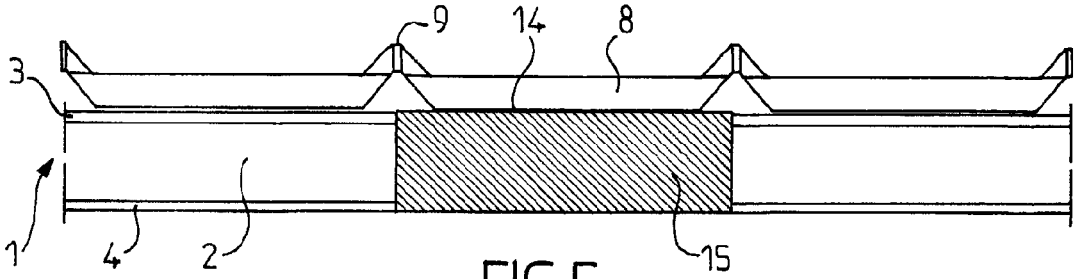
FIG. 5 is a view of a sealed and thermally insulating wall in cross section, passing through a stress-relieving slot.

In one embodiment shown in FIG. 5, the stress-relieving slot 15 is a through-slot extending over the entire thickness of the heat-insulating panel and, as a result, opening into the outer face of the panel 1. Such a stress-relieving slot 15 makes it possible to confer a high degree of flexibility to the sealing membrane relative to the deformations of the heat-insulating panel 1 whilst preserving a continuity of the internal rigid plate 3 in certain areas thereof. This continuity permits the flexibility of the heat-insulating panel 1 to be limited under thermal load. It also permits the bonding of the rigid plates 3, 4 to the layer of foam 2 to be facilitated and, as a result, incipient fractures to be limited.

Figure 6:
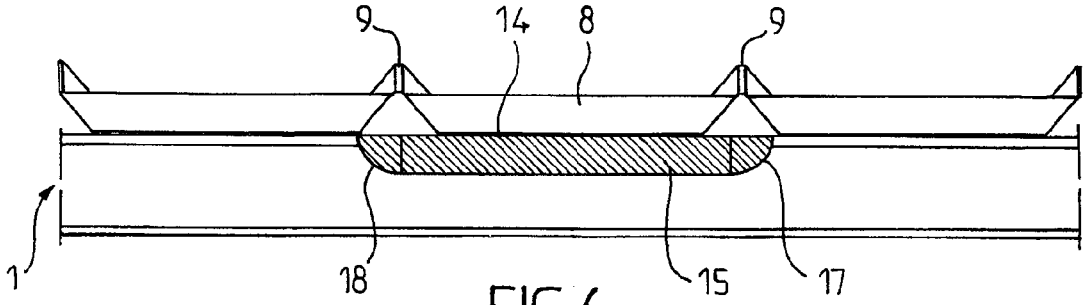
FIG. 6 is a view similar to that of FIG. 5 with a stress-relieving slot according to a further embodiment.

In a further embodiment shown in FIG. 6, the stress-relieving slot 15 is a blind slot which does not open into the outer face of the panel. Such a stress-relieving slot 15 substantially extends as far as half of the thickness of the heat-insulating panel 1. In order to limit the concentrations of stresses in the region of the bottom of the ends 17, 18 of the slot 15, the ends 17, 18 of the stress-relieving slot 15 are radiused. In order to produce these radiused portions, the stress-relieving slot 15 is typically produced by a circular saw.

Figure 2:
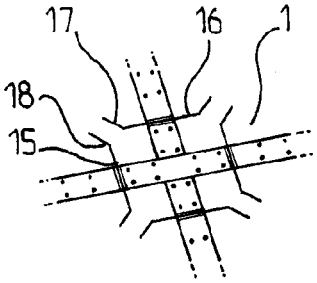
Figure 3:
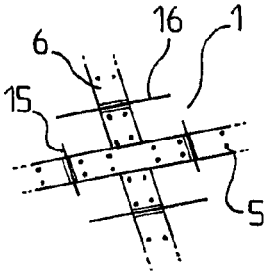
Figure 4:
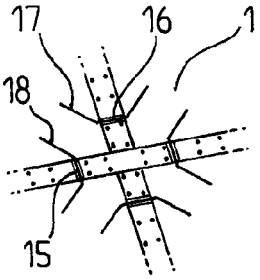

FIGS. 2 to 4 illustrate in a detailed manner the intersection area between the axis of alignment of the metal anchoring plates 5 extending longitudinally to the panel 1 and the axis of alignment of the metal anchoring plates 6 extending transversely. This intersection area corresponds to the area for fixing a corner of the metal plate 7.

In the embodiments of FIGS. 2 and 4, the stress-relieving slots 15, 16 which are arranged on either side of the intersection between the alignments of the metal anchoring plates 5, 6 are extended by an additional portion 17, 18 extending in a central direction relative to the directions x and y. In other words, the directions x and y are perpendicular here, the additional portions 17, 18 forming an angle of 45° relative to the directions x and y.

In the embodiment of FIG. 3, the decision has been made to reduce the length of the transverse stress-relieving slots 15 such that they do not intersect the longitudinal stress-relieving slots 16.

The manufacture of the heat-insulating panels 1 may be carried out according to various embodiments. According to one embodiment, the internal plate 3 and external plate 4 are, for example, bonded on either side of the layer of insulating polymer foam 2 and then the stress-relieving slots 15, 16 are cut out. Finally, when the stress-relieving slots 15, 16 have been cut out, the metal anchoring plates 5, 6 are fixed, for example, by riveting to the internal rigid plate 3.

Alternatively, it is also possible to cut out previously the internal rigid plate 3, the layer of insulating polymer foam 2 and optionally the external rigid plate 4 and then to bond the internal rigid plate 3 and external rigid plate 4 to the layer of insulating polymer foam 2 by adjusting the slots formed in the internal plate 3 and in the layer of insulating polymer foam 2.

The slots 15, 16 may be cut out by means of a device of the slotting machine type or any other appropriate device such as by means of a water jet, laser cutting, jigsaw, fret saw, milling, circular saw, or the like.

Figure 9:
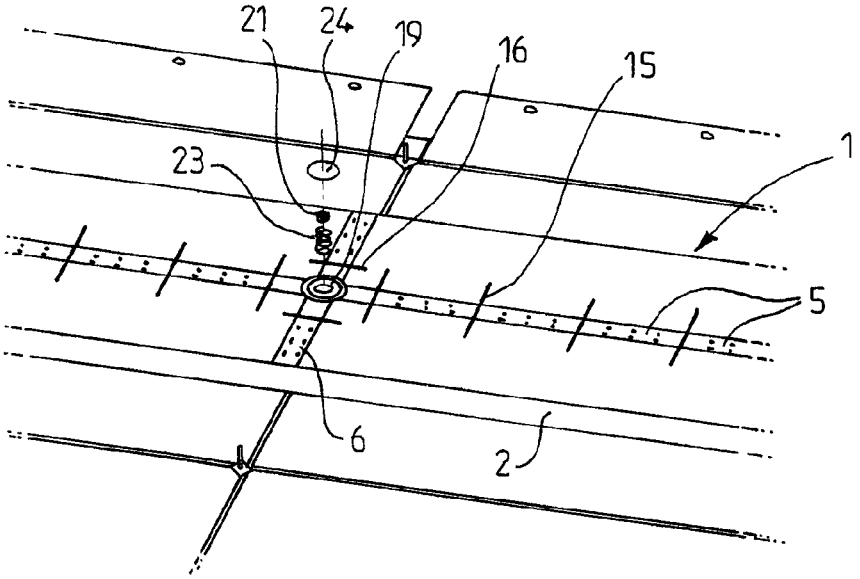
FIG. 9 is a perspective view of a heat-insulating panel fixed to the load-bearing structure in its central area.
Figure 10:
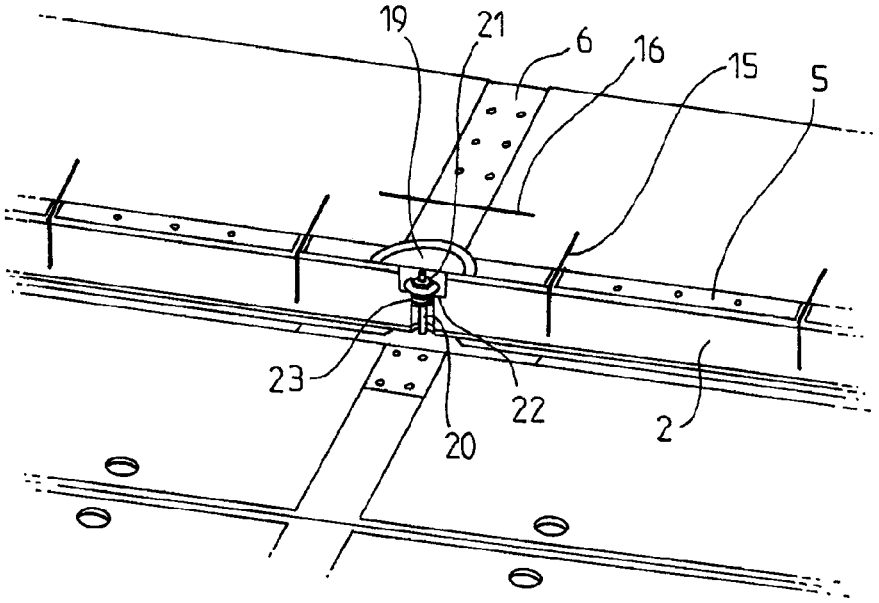
FIG. 10 is a detailed perspective view of the members for fixing to the load-bearing structure of the heat-insulating panel of FIG. 9.
Figure 11:
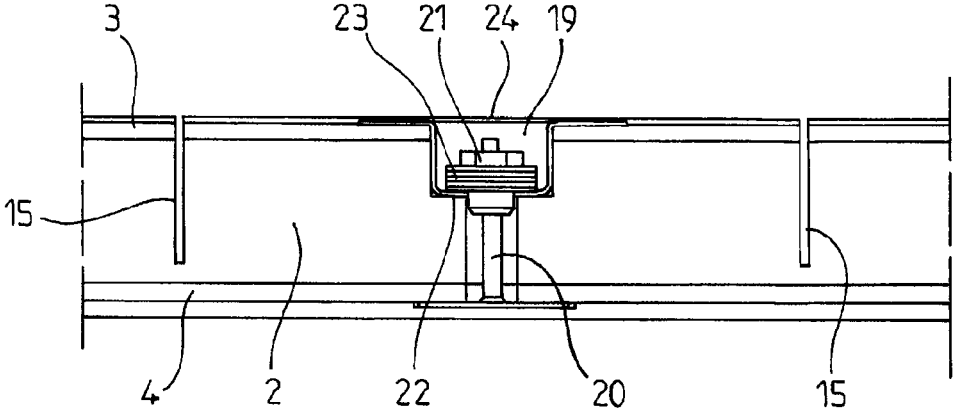
FIG. 11 is a longitudinal sectional view of the heat-insulating panel of FIGS. 9 and 10 in the region of members for fixing to the load-bearing structure.

FIGS. 9 to 11 illustrate a heat-insulating panel 1 comprising, in its central area, members for fixing to the load-bearing structure. The heat-insulating panel 1 comprises, in its central area, an orifice 19 receiving a pin 20 fixed to the load-bearing structure or to a secondary sealed and thermally insulating barrier, which is in turn fixed to the load-bearing structure when the tank has two levels of sealing and thermal insulation. The pin 20 comprises a threaded part cooperating with a nut 21. The orifice 19 comprises a shoulder 22. One or more planar washers and/or Belleville washers 23 are inserted between the nut 21 and the shoulder 22. The housing 22 in this case is sealed by a sealing disc 24.

A sealed and thermally insulating tank may comprise one or more walls as disclosed above. Such a tank may form part of a land-based storage installation, for example to store LNG, or may be installed in a floating structure, onshore or offshore, in particular an LNG carrier, a floating storage and regasification unit (FSRU), a floating production, storage and offloading unit (FPSO) and the like.

Figure 12:
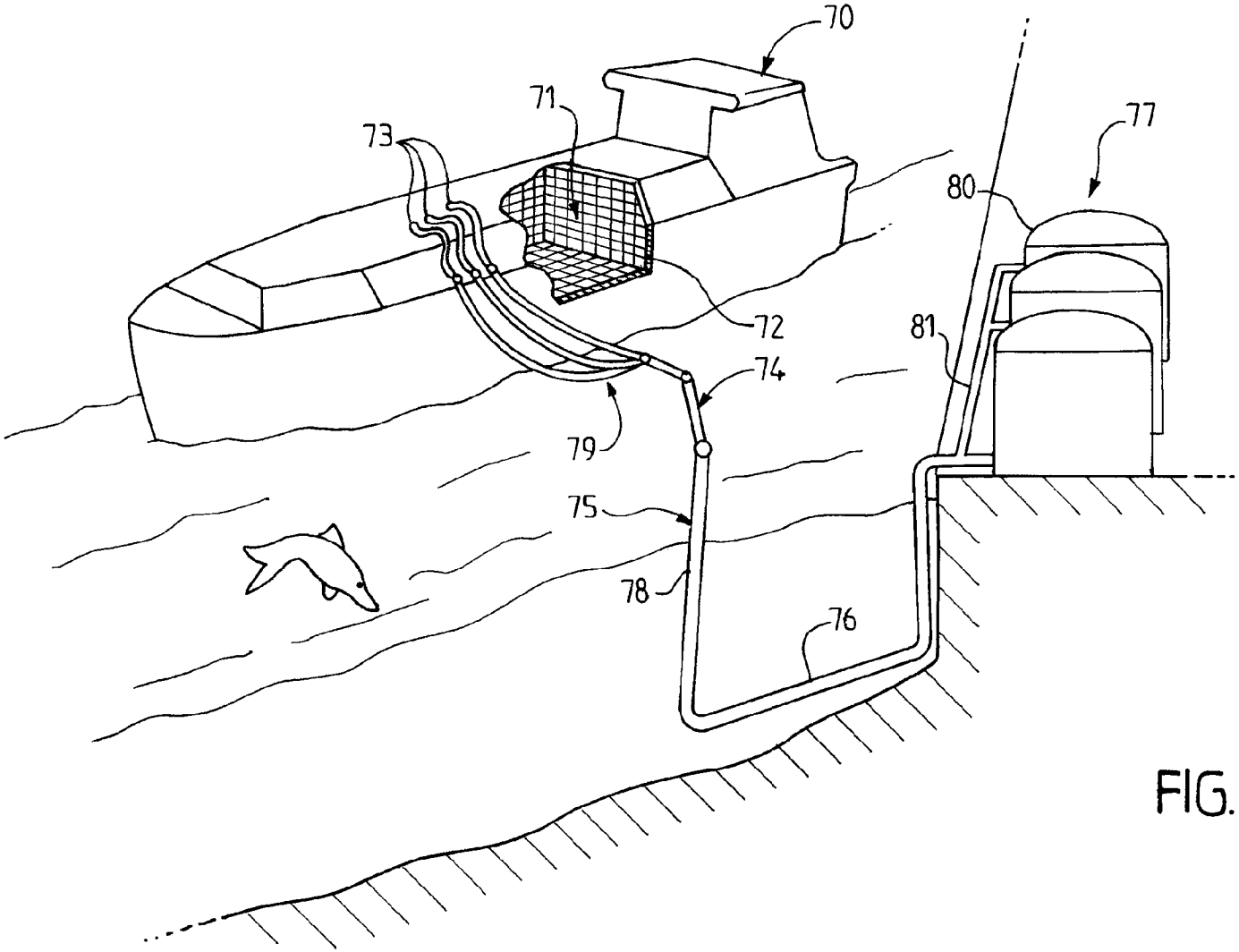
FIG. 12 is a schematic cut-away view of an LNG carrier tank and a terminal for the supply/discharge of said tank.

With reference to FIG. 12, a cut-away view of an LNG carrier 70 shows a sealed and insulated tank 71 of generally prismatic shape mounted in the double hull 72 of the vessel. The wall of the tank 71 comprises a primary sealed barrier designed to be in contact with the LNG contained in the tank, a secondary sealed barrier arranged between the primary sealed barrier and the double hull 72 of the vessel and two insulating barriers respectively arranged between the primary sealed barrier and the secondary sealed barrier and between the secondary sealed barrier and the double hull 72.

In the manner known per se, supply/discharge pipelines 73 arranged on the upper bridge of the vessel may be connected by means of appropriate connectors to a marine or harbor terminal to transfer an LNG cargo from or toward the tank 71.

FIG. 12 shows an example of a marine terminal comprising a supply and discharge station 75, an underwater pipe 76 and a land-based installation 77. The supply and discharge station 75 is a fixed offshore installation comprising a mobile arm 74 and a tower 78 which supports the mobile arm 74. The mobile arm 74 carries a bundle of insulated flexible pipes 79 which are able to be connected to the supply/discharge pipelines 73. The mobile arm 74, which is able to be oriented, is adapted to all types of LNG carriers. A connecting pipe, not shown, extends inside the tower 78. The supply and discharge station 75 permits the supply and discharge of the LNG carrier 70 from or toward the land-based installation 77. Said land-based installation comprises tanks for storing liquefied gas 80 and connecting pipes 81 connected by the underwater pipe 76 to the supply or discharge station 75. The underwater pipe 76 permits the transfer of liquefied gas between the supply or discharge station 75 and the land-based installation 77 over a long distance, for example 5 km, which permits the LNG carrier 70 to be kept at a long distance from the coast during supply and discharge operations.

To create the pressure necessary for the transfer of the liquefied gas, pumps mounted on board the vessel 70 and/or pumps provided on the land-based installation 77 and/or pumps provided at the supply and discharge station 75 are used.

Although the invention has been described in connection with several particular embodiments, it is obvious that it is not limited thereby in any respect and it comprises all the technical equivalents of the means disclosed, in addition to combinations thereof if they fall within the scope of the invention.

The use of the verbs "to consist of" "to comprise" or "to include" and their conjugated forms does not exclude the presence of other elements or other steps from those cited in a claim. The use of the indefinite article "a" or "an" for an element or a step does not exclude, unless indicated to the contrary, the presence of a plurality of such elements or steps.

In the claims, any reference between parentheses should not be interpreted as a limitation to the claim.

The invention claimed is:

1. A tank for storage of a fluid, the tank comprising:

a load-bearing structure; and at least one sealed and thermally insulating wall, the at least one sealed and thermally insulating wall comprising:

a secondary sealed and insulating barrier;

a primary insulating barrier comprising a heat-insulating panel having an inner face and a periphery, the heat-insulating panel fastened to the secondary sealed and insulating barrier by a fastening member, the fastening member comprising a pin that is fixed to the secondary sealed and insulating barrier or to the load-bearing structure, the pin comprising a threaded part cooperating with a nut, the nut bearing against the heat-insulating panel; and multiple sealing plates each having an inner face designed to be in contact with the fluid contained in the tank and an outer face anchored to the inner face of the heat-insulating panel along one of a plurality of anchoring areas, each sealing plate comprising at least one corrugation that protrudes from the inner face of the sealing plate, the at least one corrugation extending in a first direction;

wherein the inner face of the heat-insulating panel comprises a first stress-relieving slot arranged on the heat-insulating panel between two adjacent anchoring areas along which a pair of adjacent sealing plates are welded to the heat-insulating panel, the first stress-relieving slot having an axis extending in the first direction so as to permit a deformation of the corrugations transversely to the first direction; and wherein the first stress-relieving slot has a length that is less than a dimension of the heat-insulating panel along the axis of the first stress-relieving slot and does not extend as far as the periphery of the heat-insulating panel, the inner face of the heat-insulating panel comprising a first non-slotted portion extending along the first direction between a first end of the first stress-relieving slot and a first side of the periphery of the heat-insulating panel and a second non-slotted portion extending along the first direction between a second end of the first stress-relieving slot and a second side of the periphery of the heat-insulating panel so that a continuity of the inner face of the heat-insulating panel is preserved along the periphery of the heat-insulating panel.

2. The tank as claimed in claim 1, wherein the first stress-relieving slot is a through-slot that opens into an outer face of the heat-insulating panel.

3. The tank as claimed in claim 1, wherein the first stress-relieving slot is a blind slot that does not open into an outer face of the heat-insulating panel, the blind slot comprising ends that are radiused.

4. The tank as claimed in claim 1, wherein the first stress-relieving slot extends under the corrugations of the pair of adjacent sealing plates.

5. The tank as claimed in claim 1, wherein:

each of the sealing plates further comprises at least one second corrugation extending in a second direction perpendicular to the first direction;

the inner face of the heat-insulating panel further comprises a second stress-relieving slot extending across a second pair of adjacent anchoring areas; and the second stress-relieving slot has an axis extending in the second direction and has a length that is less than a second dimension of the heat-insulating panel along the second axis of the second stress-relieving slot.

6. The tank as claimed in claim 5, wherein:

each of the sealing plates comprises a first series of corrugations extending in the first direction and a second series of corrugations extending in the second direction;

the inner face of the heat-insulating panel comprises multiple first stress-relieving slots and multiple second stress-relieving slots each extending across one pair of adjacent anchoring areas;

each of the first and second stress-relieving slots has an axis that extends in one of the first direction or the second direction and has a length that is less than the dimension of the heat-insulating panel along the axis of the stress-relieving slot.

7. The tank as claimed in claim 6, wherein each stress-relieving slot has a length corresponding to a distance between two intersections of corrugations in the first or second direction.

8. The tank as claimed in claim 5, wherein the anchoring areas are aligned along two secant edges of the sealing plate.

9. The tank as claimed in claim 1, wherein at least one of the stress-relieving slots has an additional portion extending in a third direction that is oblique relative to the first and second directions.

10. The tank as claimed in claim 1, wherein the sealing plates comprise metal plates; and the inner face of the heat-insulating panel comprises metal anchoring plates welded to the metal plates along the anchoring areas.

11. The tank as claimed in claim 1, wherein the heat-insulating panel comprises a layer of insulating polymer foam sandwiched between two sheets of plywood.

12. The tank as claimed in claim 1, wherein the fastening member cooperates with a central area of the heat-insulating panel, the central area of the heat-insulating panel remote from edges of the heat-insulating panel.

13. The tank as claimed in claim 1, wherein the heat-insulating panel comprises, in a central area, members configured to be fixed to the load-bearing structure.

14. A vessel for transport of a fluid, the vessel comprising;

a double hull; and the tank of claim 1 arranged in the double hull.

15. A system for transfer of a fluid, the system comprising:

the vessel of claim 14;

one or more insulated pipelines configured to connect the tank arranged in the double hull of the vessel to a floating or land-based storage installation; and a pump configured to drive a flow of fluid through the one or more insulated pipelines between the floating or land-based storage installation and the tank of the vessel.

16. An apparatus comprising:

a tank configured to store a fluid, the tank comprising a sealed and thermally insulating wall;

wherein the sealed and thermally insulating wall comprises:

a heat-insulating panel having first metal anchoring plates extending in first and second directions from a central portion of the heat-insulating panel and second metal anchoring plates extending in third and fourth directions from the central portion of the heat-insulating panel, the first and second directions perpendicular to the third and fourth directions; and multiple metal sealing plates each comprising an inner face configured to contact the fluid in the tank, each metal sealing plate welded to at least one of the first metal anchoring plates and to at least one of the second metal anchoring plates, each metal sealing plate further comprising first corrugations protruding from the inner face of the metal sealing plate and extending in the first and second directions and second corrugations protruding from the inner face of the metal sealing plate and extending in the third and fourth directions;

wherein the heat-insulating panel further comprises first stress-relieving slots which each extend between two of the first metal anchoring plates and second stress-relieving slots which each extend between two of the second metal anchoring plates, wherein each of the first stress-relieving slots is elongated in the third and fourth directions, wherein each of the second stress-relieving slots is elongated in the first and second directions; and wherein the first and second stress-relieving slots do not intersect one another.

17. The apparatus of claim 16, wherein:

the metal sealing plates are welded to the first metal anchoring plates along the first and second directions in regions where the first stress-relieving slots are extending in the third and fourth directions; and the metal sealing plates are welded to the second metal anchoring plates along the third and fourth directions in regions where the second stress-relieving slots are extending in the first and second directions.

18. The apparatus of claim 16, wherein:

the first and second metal anchoring plates of the heat-insulating panel are welded to four metal sealing plates; and the metal sealing plates in adjacent pairs of metal sealing plates overlap one another.

19. The apparatus of claim 16, wherein:

multiple first stress-relieving slots are located in the first direction and multiple first stress-relieving slots are located in the second direction from the central portion of the heat-insulating panel; and multiple second stress-relieving slots are located in the third direction and multiple second stress-relieving slots are located in the fourth direction from the central portion of the heat-insulating panel.

* * * * *